United States Patent [19]

Mallalieu et al.

[11] Patent Number: 4,524,514

[45] Date of Patent: Jun. 25, 1985

[54] COMBINATION OF A TOOL AND A HOLLOW TOOL SECTIONAL HANDLE

[75] Inventors: David H. Mallalieu, Springfield; Samuel N. Apostola, Southbridge; Douglas C. DeVries, Webster, all of Mass.

[73] Assignee: Hyde Mfg. Co., Southbridge, Mass.

[21] Appl. No.: 502,558

[22] Filed: Jun. 9, 1983

[51] Int. Cl.[3] ..... B25G 3/30; B25G 3/32

[52] U.S. Cl. ..... 30/169; 16/111 R; 16/DIG. 24; 30/344

[58] Field of Search ..... 16/110 R, 110 A, 111 R, 16/114 R, DIG. 12, DIG. 18, DIG. 19, DIG. 24, DIG. 40; 81/177 R; 145/61 R, 61 H, 61 J; 15/143 R, 236 R; 30/169, 329, 344

[56] References Cited

U.S. PATENT DOCUMENTS

| | | | |
|---|---|---|---|
| 348,330 | 8/1866 | LaFave | 16/DIG. 12 |
| 713,231 | 11/1902 | Mansbach | 30/169 X |
| 941,901 | 11/1909 | Zinn | 145/61 R |
| 3,018,497 | 1/1962 | Echikson | 30/344 X |
| 3,759,180 | 9/1973 | Gibbons et al. | 16/110 R X |
| 3,935,787 | 2/1976 | Fisher | 16/110 R X |

FOREIGN PATENT DOCUMENTS

| | | | |
|---|---|---|---|
| 543877 | 9/1922 | France | 30/169 |

*Primary Examiner*—Fred A. Silverberg
*Attorney, Agent, or Firm*—Charles R. Fay

[57] ABSTRACT

A bladed tool wherein the blade has a tang encompassed by a pair of similar handle halves connected by a threaded fastener located in aligned bores in the two handle halves and projecting into the material of the handle halves in the bores, and a projection and hole construction on the handle halves to align the handle halves during assembly.

12 Claims, 8 Drawing Figures

COMBINATION OF A TOOL AND A HOLLOW TOOL SECTIONAL HANDLE

BACKGROUND OF THE INVENTION

Tools such as putty knives and scrapers and other similar tools have long consisted of a blade having a shank and a pair of mating plastic shell handle halves facing each other and encompassing the shank of the blade. These handle halves are customarily permanently secured together and to the shank by rivets and grommets. Cutlery is also constructed in many instances in this manner, and often special rivets are used to try to provide a handle wherein the general tendency to form sharp edges at the junction of the handle halves is minimized; and the tendency of the handle halves to open and spread pinching the user's hand is attempted to be avoided. This tendency is due to the fact that manual pressure on this type of tool is downwards and at right angles to the general plane of the tool.

In spite of such attempts in the prior art, the handle half construction still tends to be uncomfortable, especially after use, and this invention prevents the presence of the sharp side edges and the opening and spreading of the handle halves, so that the economical shell construction of the handle is greatly improved. The appearance of the new handle is also improved as it avoids the sharp edges and gaps more or less inherent in the prior art.

SUMMARY OF THE INVENTION

The beneficial results of the present invention are produced by two novel features. The shells forming the handle halves have mating side edges, and these are provided with complementary interlocking projections which preferably include alternating hole-projection-hole on one edge of each shell and projection-hole-projection on the other edge allowing each handle half to mate with any other to form the complete handle encompassing the tang of the blade. Other arrangements may also be used. The projections are preferably molded in the form of truncated cones or pyramids for easily piloting into the holes, in turn providing easier assembly and better alignment of the two halves of the handle. Other forms of projections may be used, e.g. oval, cylindrical, square or multi-sided, with or without tapered ends.

The fastener for the two shell-like handle halves simplifies assembly as well as providing for more flexing of the tool before loosening thereby lengthening the tool life, and helping to prevent gaps along the mating line of the handle halves. The fastener is a threaded or like device that is pressed into a hole in each handle that is smaller in diameter than the fastener. The handle halves are plastic with a degree of "memory", so that after the fastener is seated, the plastic material of the handle tends to flow inwardly from a displaced position into the spaces between threads, or annuli, etc., making a very strong permanent securement of the handle halves together, encompassing the tang.

PREFERRED EMBODIMENT OF THE INVENTION

Figure 1:
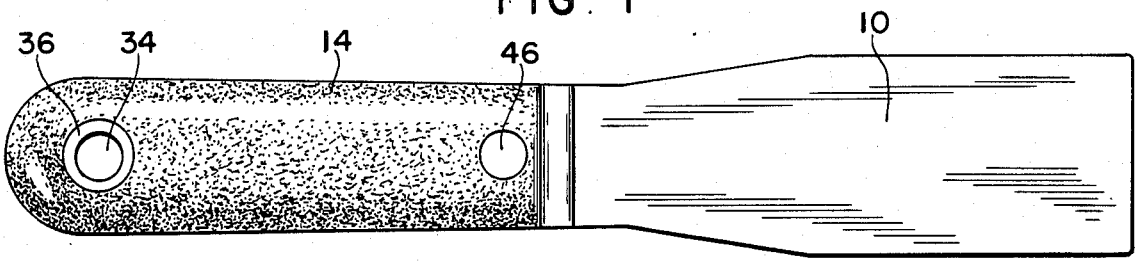
FIG. 1 is a plan view of a tool according to the invention.
Figure 2:
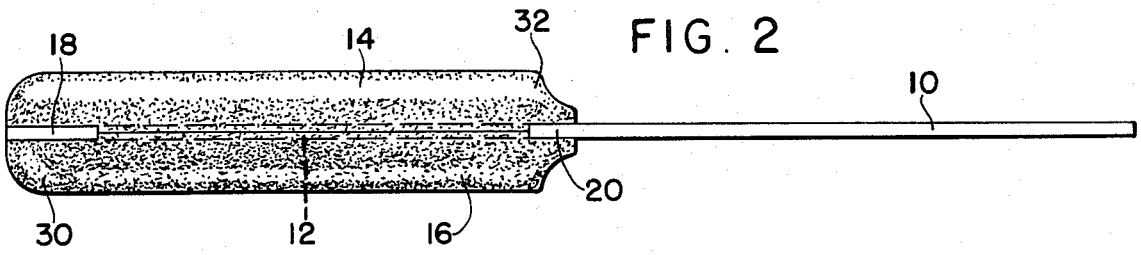
FIG. 2 is an edge view thereof.
Figure 3:
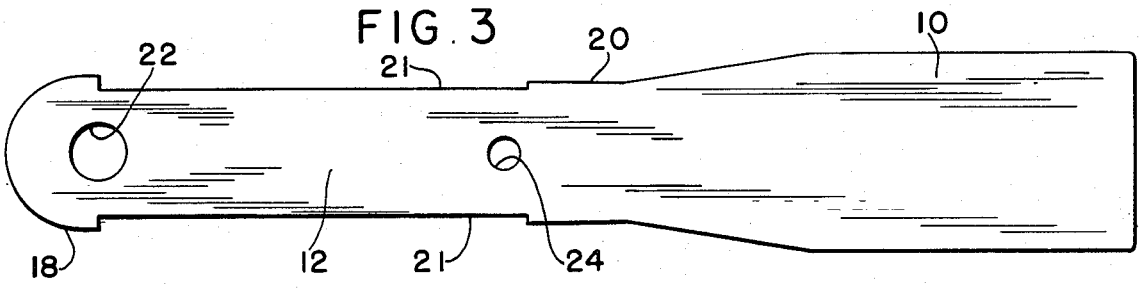
FIG. 3 is a plan view of the tool blade and its tang.

In FIGS. 1 and 2, a blade 10 is shown having a tang 12 encompassed by the two complementary shell-like plastic handle halves 14 and 16. The blade may be of any width or shape as for scraping, jointing, dry wall work, etc., but the tang in general follows the shape of the handle halves and in some cases is widened as at 18 at the end of the tang and at 20 where the tang merges with the blade. At these areas the tang is exposed and visible, FIG. 2. That is, the tang shown is indented along the side edges thereof as at 21, FIG. 3, and in these areas the tang is concealed by the edges of the handle halves. As shown in FIG. 3, the tang has a larger hole 22 near the area 18 and a smaller hole 24 near the area 20. The tang having two opposite broad flat faces along its length, the two opposite longitudinal side edges 21 and the end area 18 remote from the blade joining the pair of flat faces. The tang having an intermediate area portion 20 bordered by the indented side edges and two broad opposite end portions joined by the intermediate portion. The broad end portions merging with the tool blade and the other broad end portion being at the free end of said tang remote from said blade.

Figure 6:
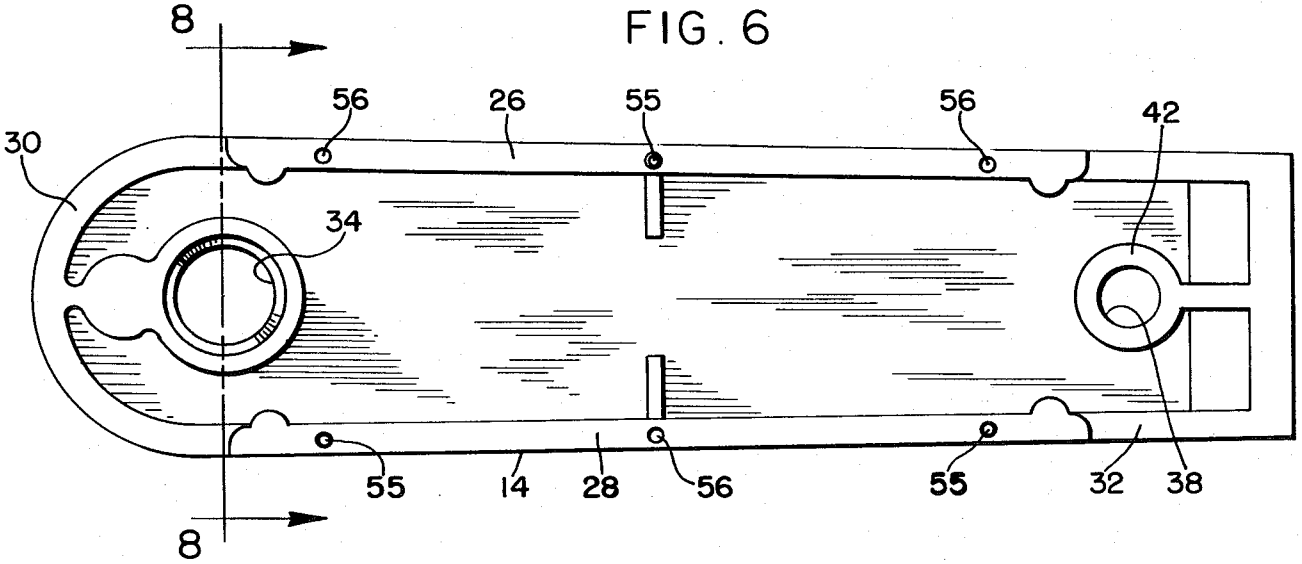
FIG. 6 is an interior view of one handle half.
Figure 7:
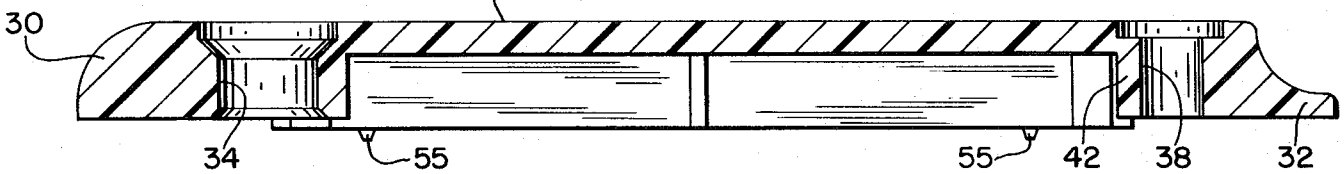
FIG. 7 is a longitudinal section through the handle half of FIG. 6.
Figure 8:
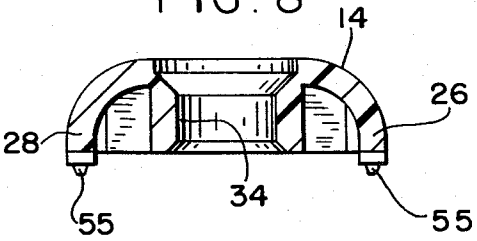
FIG. 8 is a cross section of the handle half taken on line 8—8 of FIG. 6.

The handle halves are exemplified in FIGS. 6–8 inclusive and resemble elongated shells having an elongated main part and rim parts facing and mating side edge rim portions with flat edges 26 and 28 covering the indented side edge portions of the tang even though the flat edge surface rim portions 30,32 are reduced to accommodate the visible tang ends 18 and 20. The opposite longitudinal side rim portions of the handle halves having ribs projecting laterally inwardly therefrom for reinforcing said side rim portions. The ribs providing supports for the handle tang. The relatively larger hole 22 of the tang aligns with similar holes 34 in the handle halves, the latter holes being preferably beveled to accommodate the beveled ends of a grommet 36 that aids in securing the assembly. The relatively smaller tang hole 24 aligns with bores 38,40, the bores are located in solid wall cylindrical portions 42, 44 having end surfaces contiguous with one of the flat surfaces of the tang adjacent the ends 30,32 thereof. The bores 38,40 are of less diameter than the tang hole 24, and bore 40 has a bottom, whereas bore 38 is a through hole, but has an initial offset at 60, FIG. 4, for the head 46 of the fastener to be described.

Figure 4:
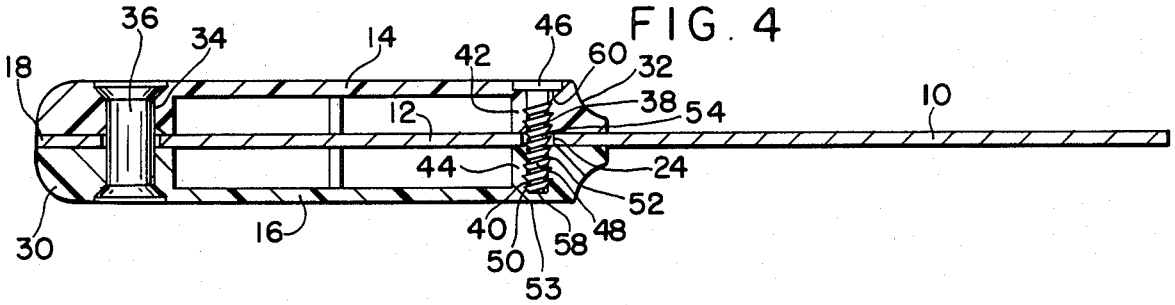
FIG. 4 is a longitudinal section through the two shell-like handle halves in assembled relation to the tang.
Figure 5:
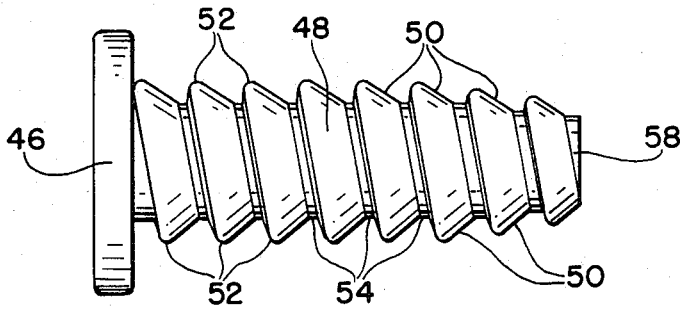
FIG. 5 is an enlarged view of the novel fastener.

The fastener is shown in FIGS. 4 and 5. It has a flat head 46 and is threaded at 48 below the head. The turns of the screw have a relatively long inclined lower surfce as at 50 and rounded apeces 52 leading into roots 54 which form a kind of fish-hook conformation with the surfaces at 50. The fastener is not as long as the handle of the tool is thick and does not appear at the opposite side of the handle from the head 46, see numeral 54 in FIG. 4.

The assembly of the two shells 14 and 16 is facilitated to some degree by the shape of the tang, but exact registry is attained by the configuration and location of a series of interlocking projections and corresponding holes on each lateral edge of the handle halves as at 55,56 in FIGS. 6, 7 and 8, the projections 55 preferably being truncated cones or pyramids or other tapered shapes for easy piloting into holes 56. These interlocks are preferably arranged as alternate hole-projection-hole and projection-hole-projection or like designs thereby allowing each handle half to mate indiscriminately to form the complete handle assembly.

During assembly, the interlocking action of the projections with the corresponding holes maintains lateral and longitudinal alignment of each handle half with the other more accurately than is otherwise attainable. Closer alignment not only results in a better appearance but eliminates exposure of the relatively sharp edges of the handle halves that can cause discomfort or injury. Also, the edges of the handle halves are prevented from the possibility of opening or spreading as in prior art putty knife and scraper handles which results in pinching the hand.

Once aligned, the novel fastener, FIG. 5, is simply pushed down through holes 38,24 and 40 in that order until the leading end of the fastener at 58 seats on the bottom of hole 40; or the head 46 seats on its seat 60. In this action, the threads 48 push aside some of the plastic material in the holes 38 and 40 tending to compact the plastic. The latter has a degree of "memory" and then pushes or flows into the root areas of the threads, thereby forming a permanent, mechanical interlock between the material of the handle and the fastener, but the latter need not project all the way through handle half 16 so that the handle at this side is plain except for grommet 36.

We claim:

1. The combination of a tool and hollow sectional handle, said tool comprising a blade with a flat elongated blade-like tang extending from said blade, said tang having two opposite broad flat faces along its length, two opposite longitudinal side edges and an end edge remote from said blade joining said pair of flat faces, said tang being indented along a major portion of said longitudinal side edges to form indented side edge portions, said tang having an intermediate portion bordered by said indented side edges and two broad opposite end portions joined by said intermediate portion, one of said two broad end portions merging with said tool blade and the other broad end portion being at the free end of said tang remote from said blade, and a pair of longitudinally spaced holes extending through said tang normal to said opposite flat faces, said hollow sectional handle comprising two complementary mating elongated shell-like halves which are secured together with one-half contiguous to one of said flat tang faces and the other half contiguous to the other of said flat tang faces, each handle half having an elongated main part and a rim about the main part, the rim of each handle half having transversely spaced opposite longitudinal side rim portions with flat edge surfaces and opposite end rim portions with flat edge surfaces which are offset from the flat edge surfaces of the longitudinal side rim portion in the direction of said main part, said handle halves having the flat faces of said opposite end rim portions pressed against the flat tang face to which the respective halves are contiguous in the area of said tang end portions and bordering same leaving the edges of said tang end portions exposed, said opposite longitudinal side rim portions of one handle half facing and mating with the opposite longitudinal side rim portions of the other handle half, the mating longitudinal side rim portions on the opposite sides of said handle halves fitting within the indentations formed in the opposite longitudinal side edges of said tang and being contiguous to said indented side edge portions of said tang, interlocking means on the opposite longitudinal side rim portions of the handle halves, said interlocking means being in the form of projections and complementary mating holes, each handle half further having two longitudinally spaced solid wall projections projecting from said main part, said solid wall projections having end surfaces contiguous with one of the flat faces of the tang, a bore in each of said solid wall projections, said solid wall projections being located in said handle halves so that the bores therein are longitudinally spaced and axially aligned with the two longitudinally spaced holes in said tang and are axially aligned with the longitudinally spaced bores of the mating handle half, there being two pairs of axially aligned bores in said mating handle halves, and fastener means in each pair of axially aligned bores in said mating handle halves for securing said mating halves together with said tang sandwiched between them, said opposite longitudinal side rim portions of said handle halves having ribs projecting laterally inwardly therefrom for reinforcing said side rim portions, said ribs providing supports for the handle tang.

2. The combination tool and handle of claim 1 wherein the projections and holes alternate.

3. The combination tool and handle of claim 1 wherein the projections taper down to free ends.

4. The combination tool and handle of claim 1 wherein there are more projections than holes on one rim edge of a handle half and more holes than projections on the other rim edge of the same handle half.

5. The combination of a tool and handle of claim 1 wherein one of said fastener means is press fit in one of said pair of axially aligned bores and passes through the tang and one handle half into the other handle half, laterally extending means on the fastener engaging and substantially penetrating the walls of the bores in at least one handle half, said laterally extending means having tapered surfaces facing the direction of thrust of the fastener into the handle halves, and more generally radial surfaces intersecting said tapered surfaces.

6. The combination tool and handle of claim 5 wherein the laterally extending means is in the form of a screw thread.

7. The combination tool and handle of claim 5 wherein the bore is of less diameter than the laterally extending means on the fastener.

8. The combination tool and handle of claim 5 including a head on the trailing end of the fastener to abut one exterior side of one handle half.

9. The combination tool and handle of claim 5 wherein the fastener has a length shorter than the distance between the outer surfaces of the combines handle halves.

10. The combination tool and handle of claim 5 wherein the leading end of the fastener terminates short of the surface of said one handle half.

11. The combination tool and handle of claim 5 wherein the interior diameter of both bores is less than that of the laterally extending means on the fastener.

12. The combination tool and handle of claim 1 wherein at least one of said solid wall projections on each handle half is a cylinder.

* * * * *